US005226866A

United States Patent [19]

Engel et al.

[11] Patent Number: 5,226,866

[45] Date of Patent: Jul. 13, 1993

[54] TRIMODAL EXERCISE APPARATUS

[75] Inventors: Timothy S. Engel, Mound; Stephen S. Peterson, Maple Grove; James R. Bostic, Waconia, all of Minn.

[73] Assignee: NordicTrack, Inc., Chaska, Minn.

[21] Appl. No.: 877,524

[22] Filed: May 1, 1992

[51] Int. Cl.[5] ..... A63B 22/00; A63B 22/02; A63B 22/04

[52] U.S. Cl. ..... 482/70; 482/54; 482/52

[58] Field of Search ..... 482/51, 52, 53, 54, 482/70, 71, 148, 114, 115, 118

[56] References Cited

U.S. PATENT DOCUMENTS

| | | | |
|---|---|---|---|
| 219,439 | 9/1879 | Blend . | |
| D. 315,764 | 3/1991 | Friedebach | D21/191 |
| 1,776,089 | 6/1930 | Wood . | |
| 1,909,190 | 5/1933 | Sachs . | |
| 3,332,683 | 7/1967 | Rand | 273/55 |
| 3,408,067 | 10/1968 | Armstrong | 272/16 |
| 3,554,541 | 1/1971 | Seaman | 272/69 |
| 3,637,206 | 1/1972 | Chickering, III | 272/69 |
| 3,642,279 | 2/1972 | Cutter | 272/69 |
| 3,941,377 | 3/1976 | Lie | 272/57 |
| 3,970,302 | 7/1976 | McFee | 272/130 |
| 4,363,480 | 12/1982 | Fisher et al. | 272/69 |
| 4,496,147 | 1/1985 | DeCloux et al. | 272/130 |
| 4,529,194 | 7/1985 | Haaheim | 272/69 |
| 4,540,172 | 9/1985 | Evans | 272/133 |
| 4,563,001 | 1/1986 | Terauds | 272/72 |
| 4,645,197 | 2/1987 | McFee | 272/65 |
| 4,659,075 | 4/1987 | Wilkinson | 272/70 |
| 4,659,077 | 4/1987 | Stropkay | 272/97 |
| 4,679,786 | 7/1987 | Rodgers | 272/70 |
| 4,679,787 | 7/1987 | Guilbault | 482/54 |
| 4,681,316 | 7/1987 | DeCloux | 272/130 |
| 4,685,666 | 8/1987 | DeCloux | 272/70 |
| 4,685,669 | 8/1987 | DeCloux | 272/130 |
| 4,708,338 | 11/1987 | Potts | 272/70 |
| 4,709,918 | 12/1987 | Grinblat | 272/97 |
| 4,720,093 | 1/1988 | Del Mar | 272/70 |
| 4,726,581 | 2/1988 | Chang | 272/70 |
| 4,728,099 | 3/1988 | Pitre | 272/72 |
| 4,733,858 | 3/1988 | Lan | 272/70 |
| 4,822,029 | 4/1989 | Sarno et al. | 272/69 |
| 4,830,362 | 5/1989 | Bull | 272/70 |
| 4,838,543 | 6/1989 | Armstrong et al. | 272/70 |
| 4,846,458 | 7/1989 | Potts | 272/65 |
| 4,909,504 | 3/1990 | Yang | 272/130 |
| 4,934,690 | 6/1990 | Bull | 272/70 |
| 4,938,474 | 7/1990 | Sweeney et al. | 272/70 |
| 4,943,049 | 7/1990 | Lo | 272/70 |
| 4,949,993 | 8/1990 | Stark et al. | 272/70 |
| 4,960,276 | 10/1990 | Feuer et al. | 272/97 |
| 4,993,704 | 2/1991 | Luczynski | 272/97 |
| 5,007,631 | 4/1991 | Wang | 272/70 |
| 5,013,031 | 5/1991 | Bull | 272/70 |
| 5,026,046 | 6/1991 | DeCloux | 272/70 |
| 5,044,355 | 9/1991 | Reopelle | 128/25 B |
| 5,108,093 | 4/1992 | Watterson | 482/70 |
| 5,114,388 | 5/1992 | Trulaske | 482/52 |
| 5,171,196 | 12/1992 | Lynch | 482/54 |

FOREIGN PATENT DOCUMENTS

| | | | |
|---|---|---|---|
| 672583 | 10/1963 | Canada | 272/30 |
| 384019 | 12/1932 | United Kingdom . | |
| 416105 | 9/1934 | United Kingdom . | |

*Primary Examiner*—Stephen R. Crow

[57] ABSTRACT

An exercise device (1) capable of performing three discrete exercise activities, and including a treadmill (9) suitable for simulating a running or walking exercise, and further including a pair of slidable foot restraints (34, 35) mounted within rails (56, 57) adjacent to the treadmill (9) in order to simulate a cross country skiing exercise. A pair of reciprocating, pivotable foot paddles (58, 59) are cooperatively attached in a first embodiment to pneumatic cylinders (89, 90), while in a second embodiment are cooperatively attached to conical resistance mechanisms (112, 113) so as to simulate a stair climbing activity. A pivotable torso support (11) is provided to assist the balance of a person performing any of the three exercise activities.

21 Claims, 13 Drawing Sheets

FIG. 7
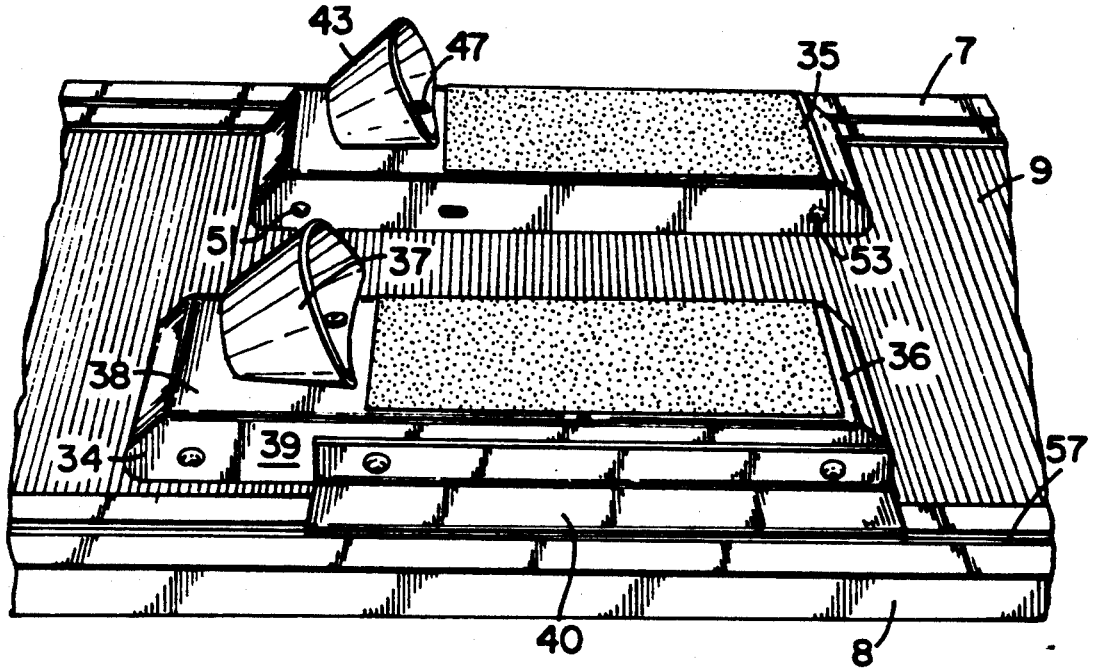
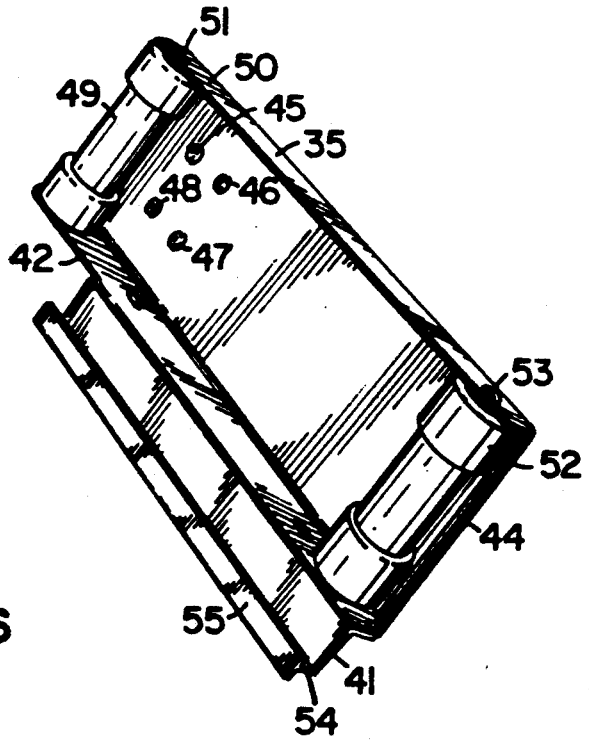
FIG. 6

FIG. 13
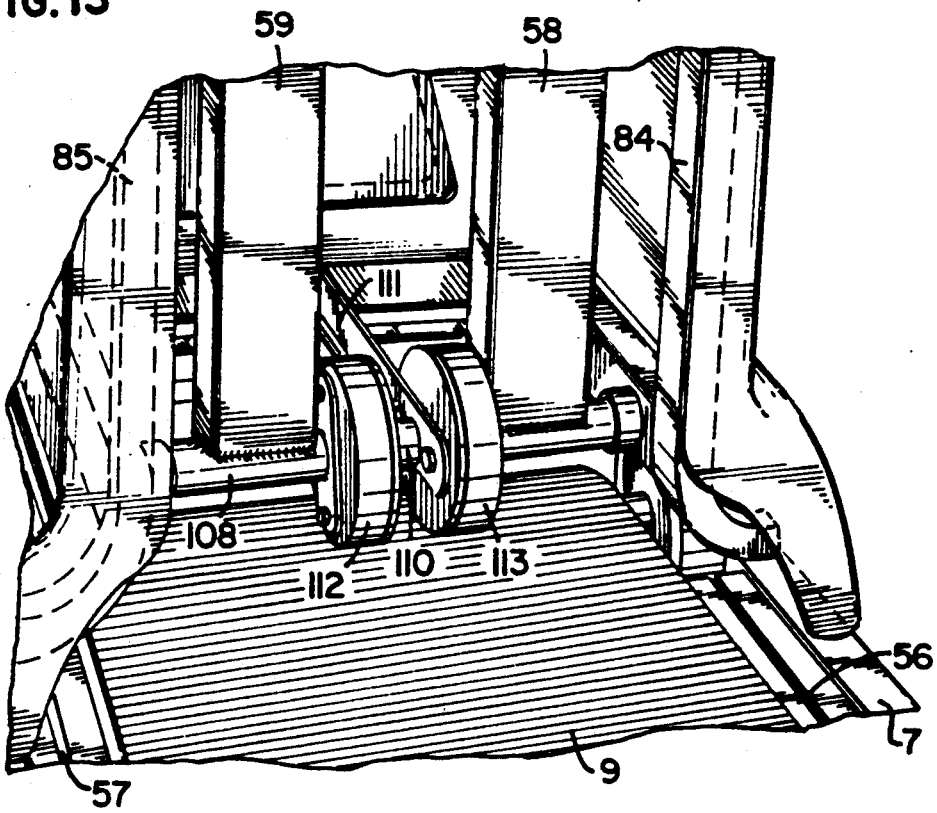
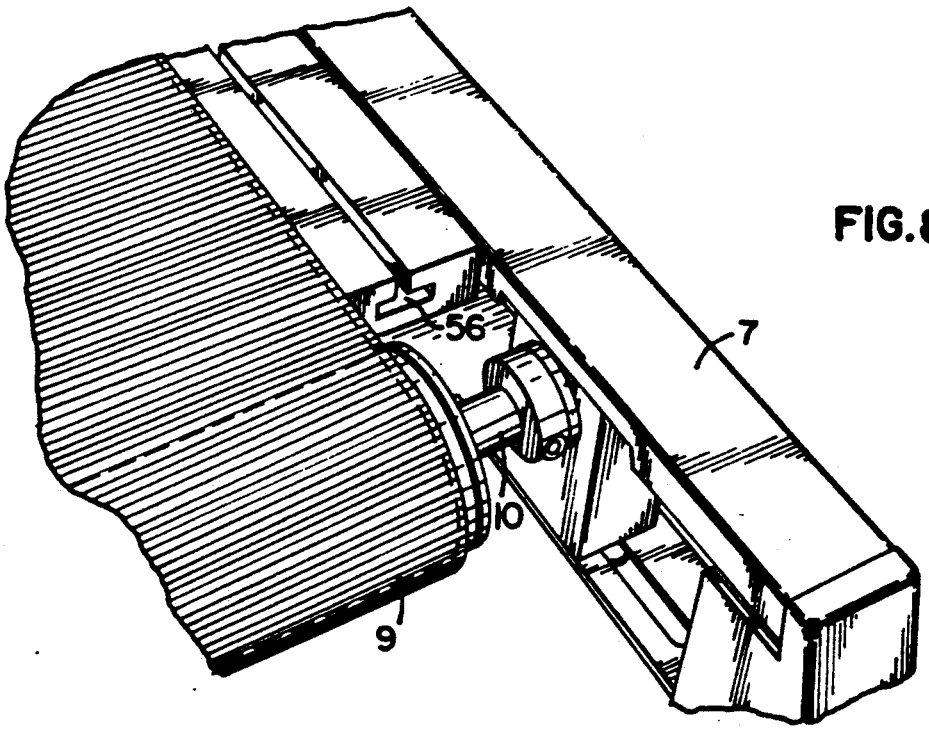
FIG. 8

FIG. 15
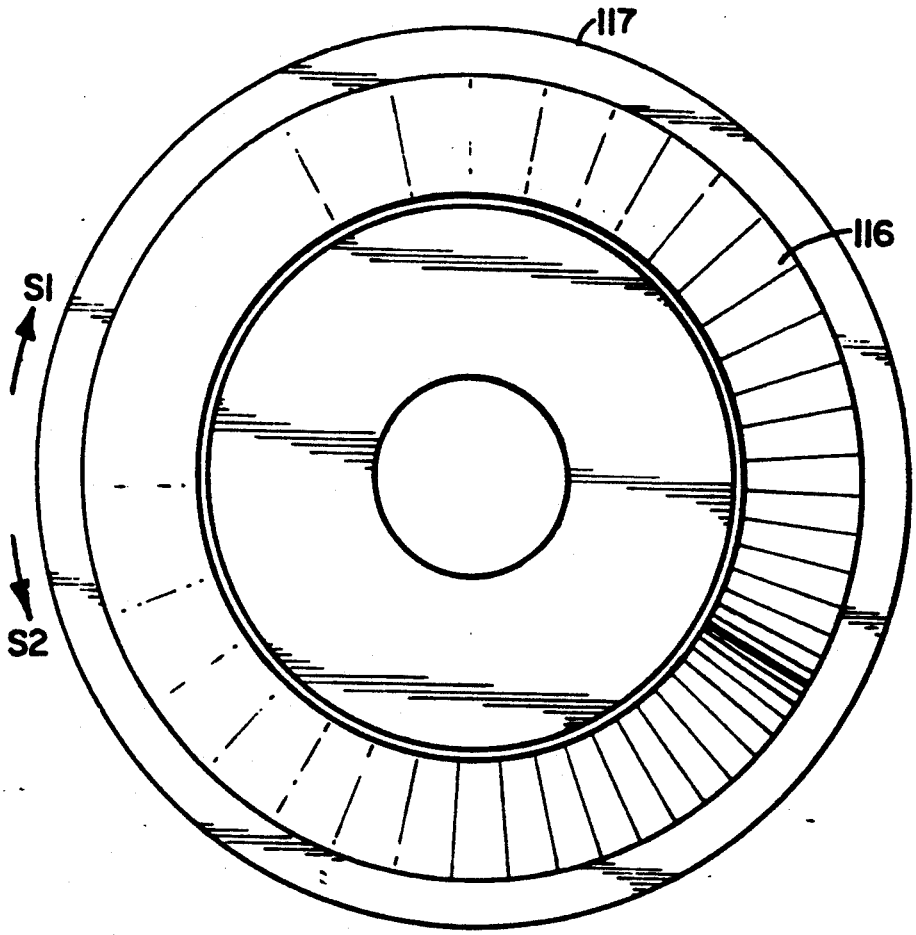
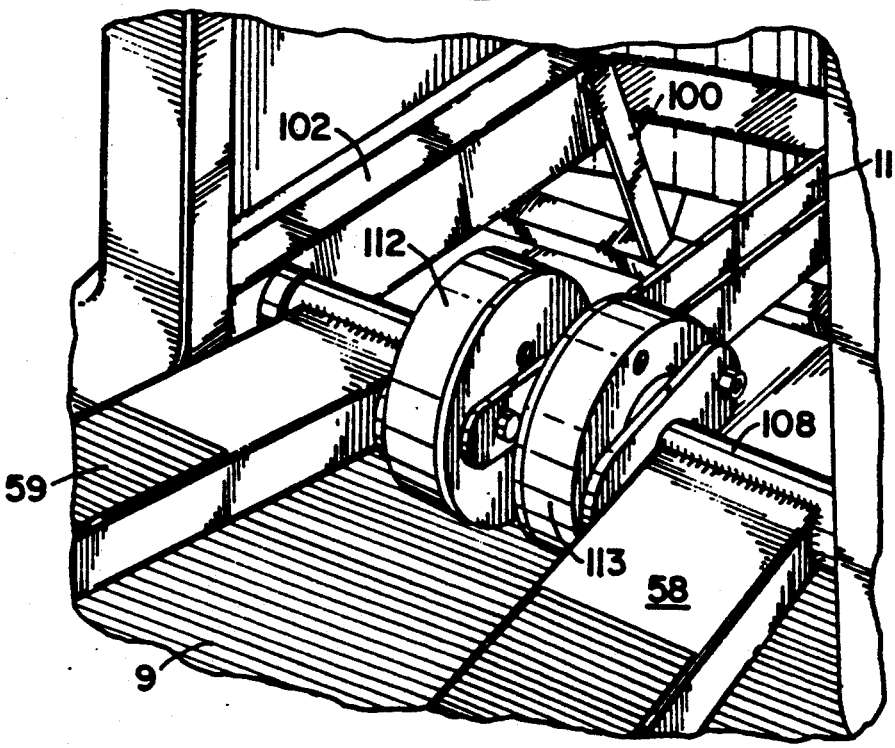
FIG. 16

TRIMODAL EXERCISE APPARATUS

BACKGROUND OF THE INVENTION

1. Field of the Invention

The present invention relates to an exercise device which is adapted to facilitate the performance of three distinctly different types of bodily exertion. In particular, the present apparatus is readily adapted to serve as a device which simulates the climbing of stairs, cross country skiing motions, or walking.

2. Description of Related Technology

Numerous devices have been developed to permit exercise that simulates vigorous body movement which would normally cause the person exercising to move over the surface of the ground a considerable distance, but which instead permit this activity to occur while the person exercising remains on a stationary platform. The obvious advantages are that the exercise may be performed in a small space, indoors, and without a large specially prepared surface. The disadvantage of such devices is that they have typically either simulated a natural activity, such as walking, fairly poorly, or while simulating a particular exercise fairly well, have been limited to that single type of exercise activity. Therefore, a person who would wish to participate in a wide variety of activities on a stationary platform would have to purchase a variety of discrete, dedicated exercise platforms.

Examples of such stationary exercise platforms include that disclosed in U.S. Pat. No. 1,909,190, issued to Sachs, which is an inclined platform utilizing reciprocating foot platforms, interconnected by a cable, such that a walking motion may be simulated.

U.S. Pat. No. 2,052,102, issued to Morgan, discloses a "walking in place" device, in which two foot pads, residing side by side, are interconnected to a coil spring arrangement such that the foot pad is constrained to move vertically. The coil spring provides greater resistance as the foot pad moves towards a lower horizontal plane.

U.S. Pat. No. 2,892,455, issued to Hutton, discloses a power driven walking trainer which causes pivoted foot pedals to move automatically, the person's feet being affixed to the moving pedals so as to force the person's body to simulate a walking motion. A similar device is disclosed in U.S. Pat. No. 3,316,898, issued to Brown, wherein a motor drives two pivoted foot pedals. The Brown device is intended for a person in a somewhat healthier condition than the Hutton device, insofar as the Brown device does not include any means for supporting the patient's body and requires that the patient maintain their own balance and posture during exercise.

U.S. Pat. No. 3,501,142, issued to Johansson, discloses a bicycle type exercise device including a flywheel which is brought into frictional engagement with a belt, thereby permitting the resistance to movement to be varied, and permitting simulation of bicycling along an incline.

U.S. Pat. No. 3,746,355, issued to Fichter et al., discloses a starting block and rail assembly which may be used for supporting a foot, ostensibly as a starting block for use during track events.

U.S. Pat. No. 3,833,216, issued to Philbin, discloses a bicycle exercise device having a manually operated lever to vary the resistance encountered by the cycler. A retainer device is included so that the resistance setting, once chosen, is maintained within predetermined limits.

U.S. Pat. No. 3,970,302, issued to McFee, discloses a stair climbing device with diagonally sliding carriages having pneumatic or hydraulic cylinders to provide resistance to a pair of reciprocating foot rests. In an alternate embodiment, a pair of pivoting levers are used as the foot supports.

U.S. Pat. No. 4,047,715, issued to Gjessing, discloses a rowing device incorporating a one-way clutch apparatus such that a flywheel may rotate in only one direction.

U.S. Pat. No. 4,188,030, issued to Hooper, discloses a bicycle device including reciprocating hand levers which move automatically in response to the cycling motion caused by operation of the cycle foot pedals.

U.S. Pat. No. 4,496,147, issued to Decloux et al., discloses a stair climbing device having hydraulically phased steps operating along an inclined track. The Decloux et al. device may be collapsed to form a relatively compact structure, thereby simplifying storage problems in a household environment.

U.S. Pat. No. 4,537,396, issued to Hooper, discloses a device which permits the simulation of a swimming motion with the arms, and in an alternate embodiment a rowing activity or a pedaling activity.

U.S. Pat. No. 4,555,108, issued to Monteiro, discloses a stair stepping device having a disk with eight projections, each projection serving as a stair. Rotation of the disk is retarded somewhat by a hydraulic resistance mechanism, thereby permitting the user to rotate the disk at the same rate at which the projections, or stairs, are climbed.

U.S. Pat. No. 4,643,418, issued to Bart, discloses an exercise treadmill containing electric motors which allow the entire treadmill frame to be inclined during use.

U.S. Pat. No. 4,659,077, issued to Stropkay, discloses an exercise device which simulates a cross country skiing exercise.

U.S. Pat. No. 4,679,786, issued to Rogers, discloses a combination exercise device which simulates bicycling, rowing, as well as a skiing motion U.S. Pat. No. 4,681,316, issued to Decloux, discloses a stair climbing device having interconnected hydraulic systems and a diagonally mounted track.

U.S. Pat. No. 4,685,666, issued to Decloux, discloses a trackless climbing simulation device in which a pair of steps are connected to cylinder rods, thereby simulating a stair climbing motion.

U.S. Pat. No. 4,685,669, issued to Decloux, discloses a stair climbing device including a hydraulic fluid system for altering the stair climber's center of gravity during the descent phase of the step.

U.S. Pat. No. 4,708,128, issued to Ancillotti, discloses a stationary bicycle in which the position of the pedals may be altered so as to aid in the treatment of various knee injuries.

U.S. Pat. No. 4,708,338, issued to Potts, discloses a stair climbing device using pivoting lever members.

U.S. Pat. No. 4,709,918, issued to Grinblat, discloses an exercise device which can simulate cross country skiing, rowing, and a variety of pulling exercises designed to stimulate the arms and torso.

U.S. Pat. No. 4,712,791, issued to Edwards, discloses an exercise machine designed to simulate a jogging motion, with the added feature of being able to incline the exerciser rearwardly while jogging.

U.S. Pat. No. 4,720,093, issued to Delmar, discloses a stair climbing device designed to be used in the weightless environment of space.

U.S. Pat. No. 4,726,581, issued to Chang, discloses a stair climbing device which simulates stair climbing with a system of revolving steps connected to an endless belt or chain.

U.S. Pat. No. 4,786,050, issued to Geschwender, discloses a device having a pair of pivoted foot pedals simulating a climbing motion which are interconnected to a pair of hand cranks, thereby simulating a skiing motion U.S. Pat. No. 4,798,379, issued to Jenkins, discloses an exercise machine in which the user sits while manipulating pivoting lever members for both the arms and the legs.

U.S. Pat. No. 4,842,268, issued to Jenkins, discloses a second embodiment of a stair climbing device with pivoting lever members for the arms and legs. The device is used while the exerciser is in a sitting position U.S Pat. No. 4,946,162, issued to Lubie, discloses a portable exercise device which simulates a pedaling motion. The device is designed to be used while a person is sitting in a chair.

U.S. Pat. No. 4,960,276, issued to Feuer et al., discloses a cross country ski simulation device including a series of parallel tracks for engagement by foot grips and hand levers.

U.S. Pat. No. 3,511,500, issued to Dunn, discloses a constant resistance exercise device in which the user "teeter-totters" on foot pads while holding an anchored handle in each hand.

U.S. Pat. No. 4,618,139, issued to Haaheim, discloses an exercise machine in which the user's feet slide back and forth on wheeled trucks while the arms push and pull pivoting lever members.

U.S. Pat. No. 4,838,543, issued to Armstrong et al., discloses a low impact exercise device which simulates stair climbing by means of pivoting lever members.

U.S. Pat. No. 3,747,924, issued to Champoux, discloses an oscillating pedal exercise device in which the user balances on pivoting lever members.

U.S. Pat. No. 4,563,001, issued to Terauds, discloses a portable exercise device which simulates stair climbing as well as arm exercises utilizing pivoting lever members.

U.S. Pat. No. 3,759,511, issued to Zinkin et al., discloses an adjustable friction type exercising device which simulates a running motion with pivoting lever members and supports for the chest and hands.

U.S. Pat. No. 4,600,187, issued to Schenker, discloses a stair climbing device with pivoting lever members.

U.S. Pat. No. 4,830,362, issued to Bull, discloses a stair climbing and arm exercise device utilizing pivoting lever members.

U.S. Pat. No. 4,477,072, issued to Decloux, discloses a bimodal exercise device which simulates both "sitting down" and "standing up" bicycle pedaling motions.

U.S. Pat. No. 4,519,603, issued to Decloux, discloses an exercise device which simulates a "tanding up" pedaling motion.

U.S. Pat. No. 4,934,690, issued to Bull, discloses a stair climbing and arm exercising device utilizing pivoting lever members.

As the aforementioned devices demonstrate, a need exists for a single integrated device which permits the simulation of stair climbing, cross country skiing and running and walking type exercise motions.

SUMMARY OF THE INVENTION

The present invention provides an apparatus of the type on which a person exercises. The present apparatus is a combined ski machine, stair stepper and treadmill. In the ski machine configuration, two foot locks or skates are individually slidable along generally horizontal bases or skate rails. An arm exerciser, which includes a central upright member, a chest pad and a pivoting arm exerciser tube that carries a cord and drum assembly is secured to a pedestal anchored at one end of the skate rails. When the device is used as a stair stepper, the skate rails are removed from the device.

The treadmill is attached to an endless loop or conveyor that passes around front and rear rollers supported at each end of the skate rail assemblies. The front roller axle also supports a flywheel mechanism which is at the base of the pedestal assembly. In the preferred embodiments, the stair stepper pedals are attached to either hydraulic or pneumatic cylinders which simulate a stair climbing motion.

BRIEF DESCRIPTION OF THE DRAWINGS

FIG. 6 is a perspective view showing the underside of the skate or foot pad depicted in FIG. 5;

FIG. 7 is a perspective view showing the skate or foot pads of FIG. 6 mounted on the apparatus of FIG. 5;

FIG. 8 is a perspective view of a portion of the base of the apparatus depicted in FIG. 5 showing details of the securing arrangement for the foot pads of FIG. 7;

FIG. 13 is a perspective view of a portion of the rotational resistance means depicted in FIG. 12 as mounted on the apparatus depicted in FIG. 9;

FIG. 15 is an enlarged front view of a cone member comprising a part of the rotational resistance means shown in FIG. 12;

FIG. 16 is a perspective view showing details of the mounting arrangement of the cone clutch depicted in FIG. 15.

DESCRIPTION OF THE PREFERRED EMBODIMENT

Figure 1:
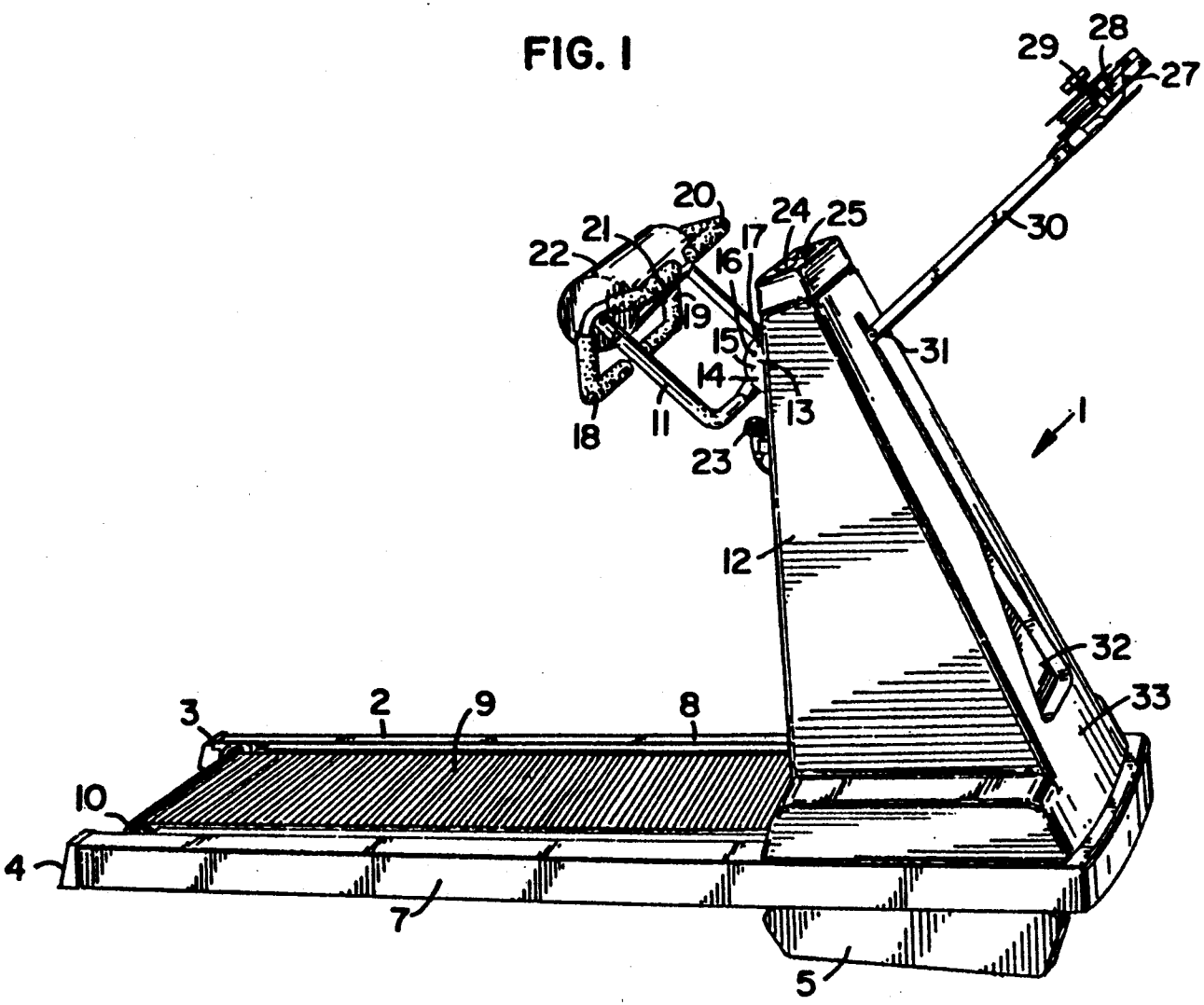
FIG. 1 is a perspective view of an apparatus constructed in accordance with the principles of the present invention.
Figure 4:
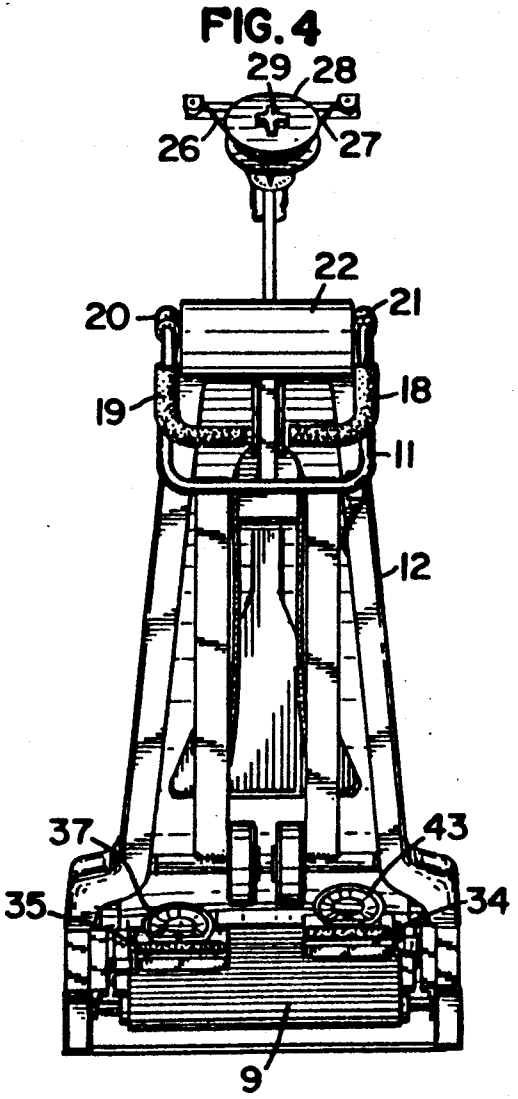
FIG. 4 is a rear elevation of the apparatus of FIG. 3.
Figure 2:
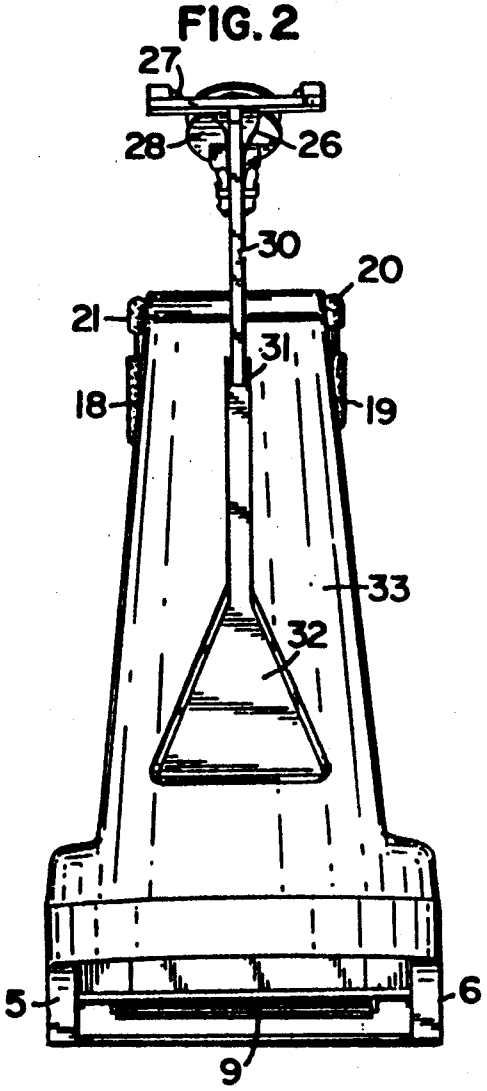
FIG. 2 is a front elevation of the apparatus depicted in FIG. 1.
Figure 3:
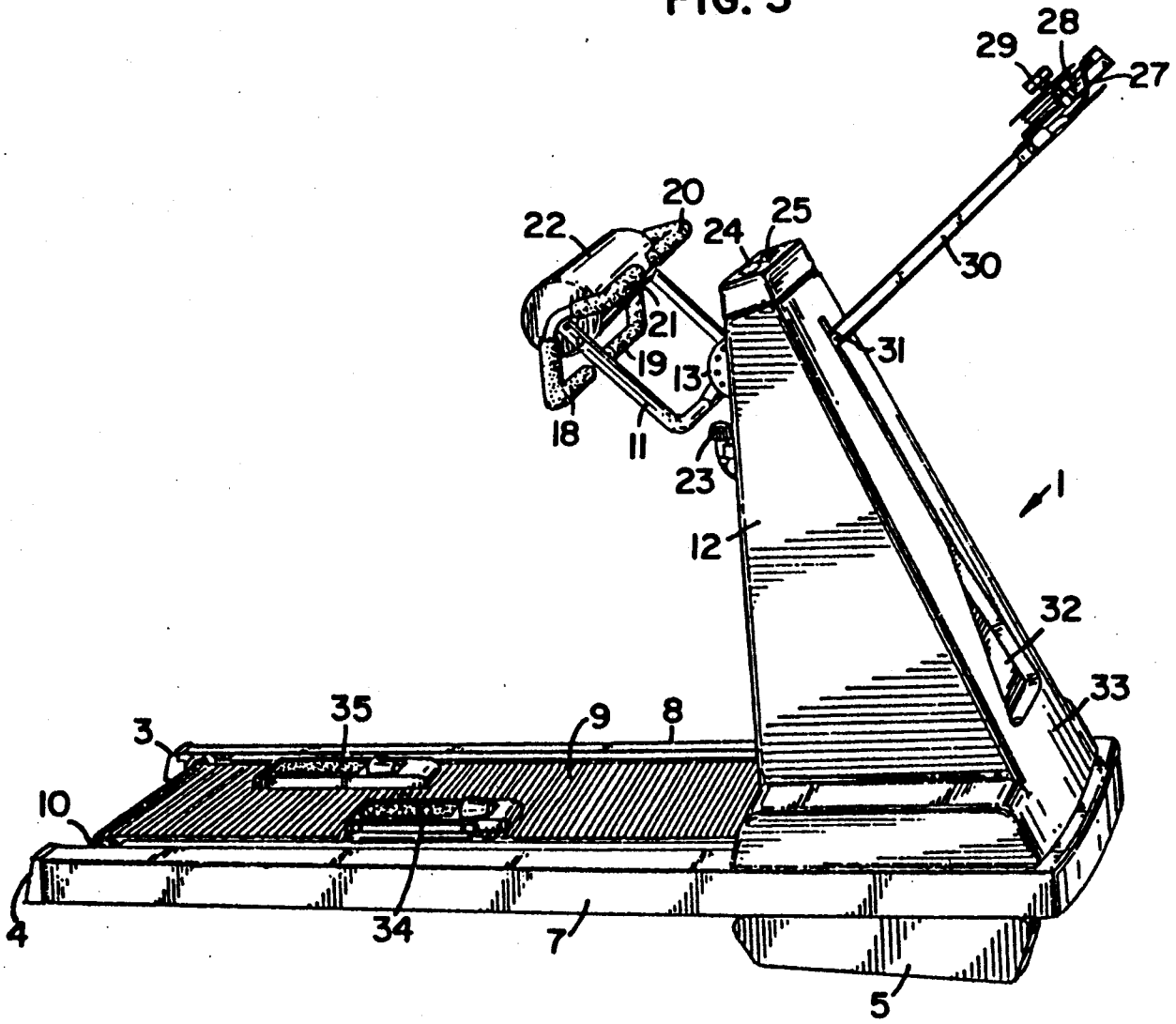
FIG. 3 is a perspective view of the apparatus of FIG. 1 with the addition of skate or foot pads used in a cross country skiing exercise.
Figure 5:
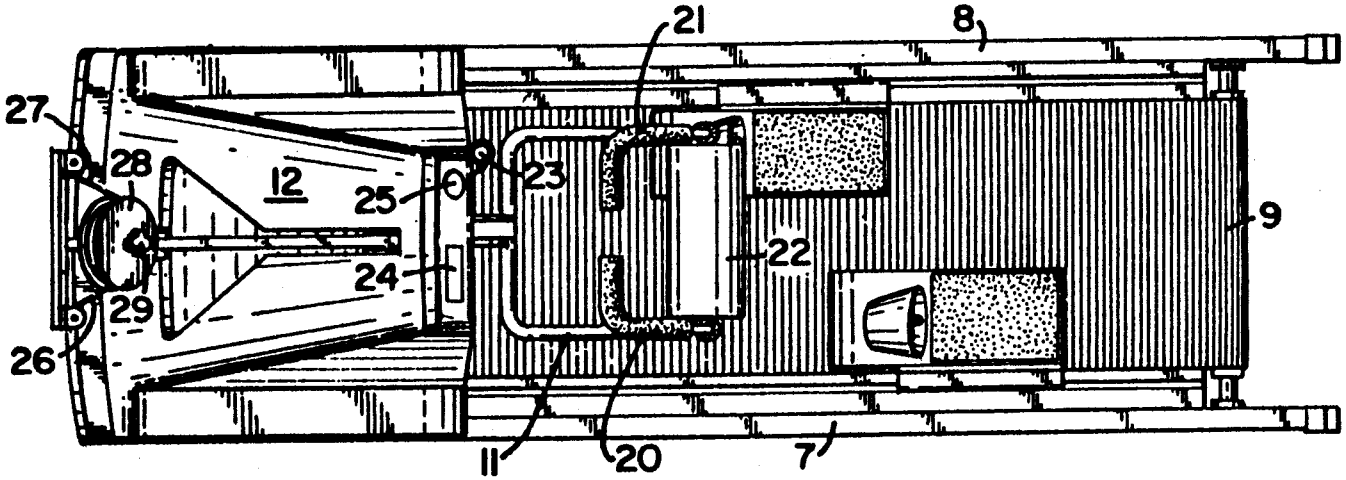
FIG. 5 is a top plan view of the apparatus depicted in FIG. 4.

Referring to FIG. 1, an exercise device built in accordance with the principles of the present invention is shown generally at 1. The device includes a substantially planar base portion 2 which is supported at a rearward end by pads 3 and 4, while the forward end is supported at a somewhat greater height by base supports 5 and 6. The result is that base portion 2 is inclined from a horizontal plane at a fixed angle within the range of 0° to 50°.

Base 2 is formed by side rails 7 and 8, which define an area between them occupied by tread 9. Tread 9 is formed as a continuous loop of a resilient material spanning substantially the entire width between rails 7 and 8, and is supported at the rear by spool 10 and is supported at its forward end by another spool or roller mechanism (not shown). Thus, a person standing on treadmill 9 may engage in a walking or running motion while the upper surface of treadmill 9 translates in a rearward direction, the person exercising thereby remaining in a substantially stationary position above base or deck 2.

In order to aid in the support and balance of the person exercising, a chest or stomach support 11 is provided. Support 11 is pivotably attached to pedestal 12 which is supported at the forward end of base 2.

Stomach support 11 pivots about hub 13 and may be stopped at a series of angular orientations controlled by the position of stops 14, 15, 16, 17, etc. At an opposite end of stomach support 11 are affixed hand holds 18, 19, 20 and 21, as well as padded support 22. A person using the apparatus 1 may either grasp any of the handles 18–21 and/or rest a portion of their torso against padded support 22 while walking or running on treadmill 9.

Figure 17:
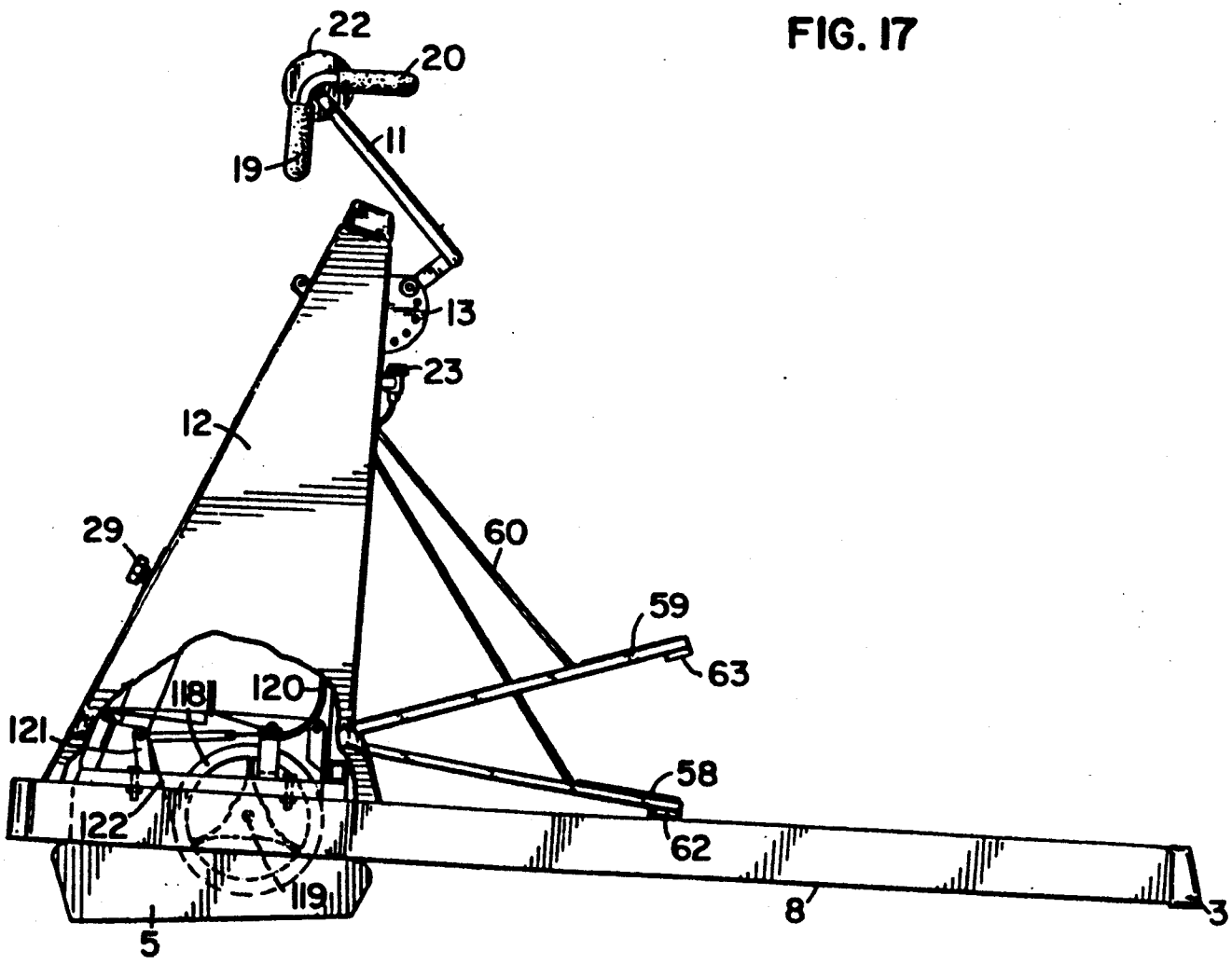
FIG. 17 is a side elevation of the apparatus depicted in FIG. 1, with a portion broken away to reveal details of the flywheel mechanism.

Resistance of the treadmill may be conveniently controlled by the user by manipulating knob 23, while the rate of exercise or other parameters may be conveniently displayed on indicators 24 and 25 mounted at the top of pedestal 12. Referring to FIG. 17, the flywheel 118 is seen to be interconnected to front axle 119 upon which treadmill 9 is suspended. Tension adjustment knob 23 is connected by bowden cable 120 to a tension adjustment lever 121. By extending the length of cable 121, the friction producing strap 122 is tightened around flywheel 118, thereby increasing the resistance perceived by a user of the treadmill.

Additionally, a person utilizing the treadmill 9 may also exercise the arms by manipulating cables 26 and 27 which may be grasped by handholds (not shown) when the cables are extended from drum 28. The resistance to movement of the cables 26 and 27 may be controlled by a person adjusting knob 29 which is mounted on drum 28.

Drum 28 is supported on pivoting arm 30, which pivots at its base 31. When use of the cables 27 and 26 is not desired, the entire drum/arm assembly 28/30 may be pivoted and stored within recess 32 which is formed within the front surface 33 of pedestal 12.

Referring now to FIGS. 3–8, a second configuration of the apparatus 1 is described. In the cross country skiing configuration, right foot pad 34 and left foot pad 35 are placed on treadmill 9. Footpad 34 includes a relatively resilient, high coefficient of friction foot engaging surface 36 and toe restraint 37 mounted at the forward portion of substantially planar surface 38. Footpad 34 is advanced along rollers which include one-way clutch mechanisms.

Affixed to the left side 39 of foot pad 34 is a rail engaging member 40.

As seen in FIG. 6, left foot pad 35 is formed in a substantially identical manner to right foot pad 34, except that rail engaging member 41 is affixed to the right side 42 of foot hold 35.

Toe restraint 43 is secured to planar member 44 by means of bolts 45, 46, 47 and 48.

At the forward end of foot pad 35 is affixed a spool or roller 49 incorporating a one-way clutch mechanism which is rotatably affixed to side walls 42 and 50 by axle 51. Similarly, a rear spool or roller 52 having a one-way clutch incorporated therein is affixed to the rear portion of foot pad 35 by means of axle 53.

As can be seen in FIGS. 6 and 8, the rail gripping member 41 is formed so as to have a T-shaped channel 54 and a substantially planar "T" flange 55. The flange 55 fits within groove 56 which is formed adjacent to side rail 7 of base member 2. A similar groove 57 is formed within left rail 8 and grasps rail engaging member 40 of left foot pad 34.

In operation, a person wishing to do a cross country ski exercise places their feet in foot pads 34 and 35 and slides their feet along tread 9, thereby simulating a skiing motion. As mentioned earlier, the footpads 34, 35 slide on rollers incorporating one-way clutch mechanisms such that rearward movement of either footpad disengages the clutch, thereby preventing rotation of the rollers. Thus, the rollers grip belt 9, causing belt 9 to move rearwardly. On the forward stroke, the rollers are free to turn, thereby rolling over the surface of belt 9.

As in the walking or running configuration, the user may grasp handles 18, 19, 20 or 21, or may rest a portion of their torso against pad 22 and grasp cables 27 and 28 in order to provide exercise for the arms.

Figure 9:
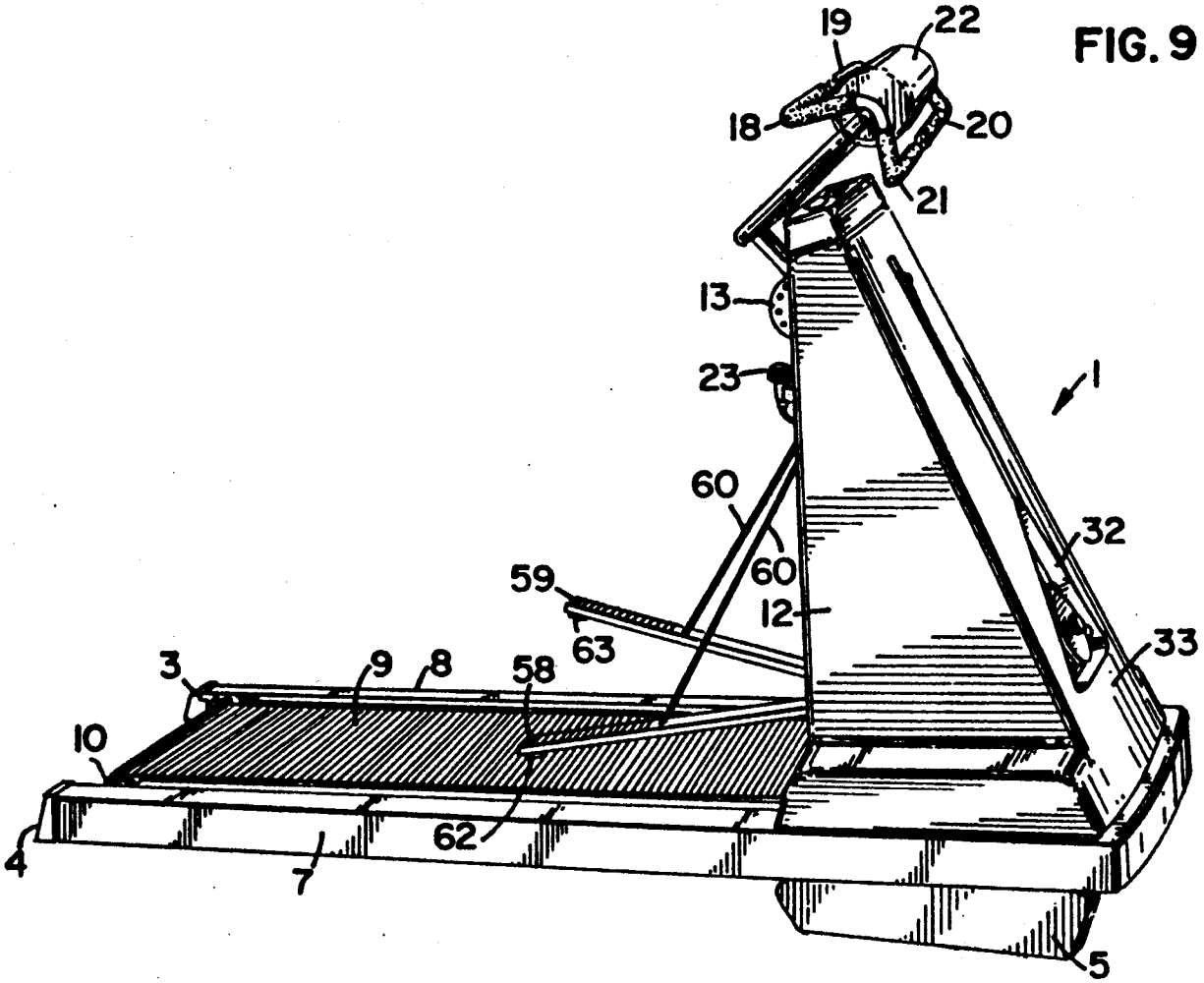
FIG. 9 is a perspective view of the apparatus of FIG. 1 showing the stair stepping levers extended for use in a stair stepping exercise.
Figure 10:
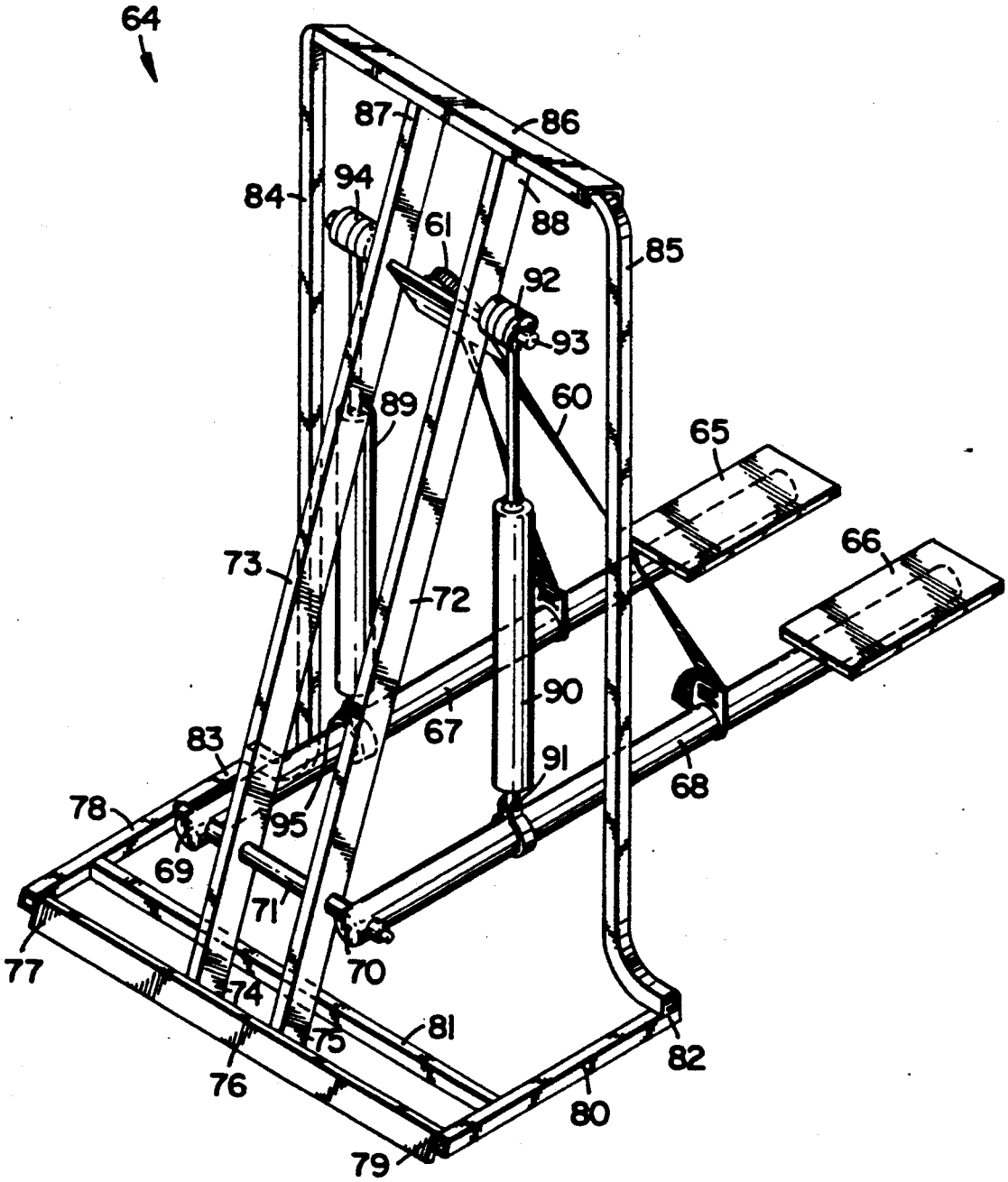
FIG. 10 is a perspective view showing the stair stepping mechanism of one embodiment of the apparatus depicted in FIG. 9.
Figure 11:
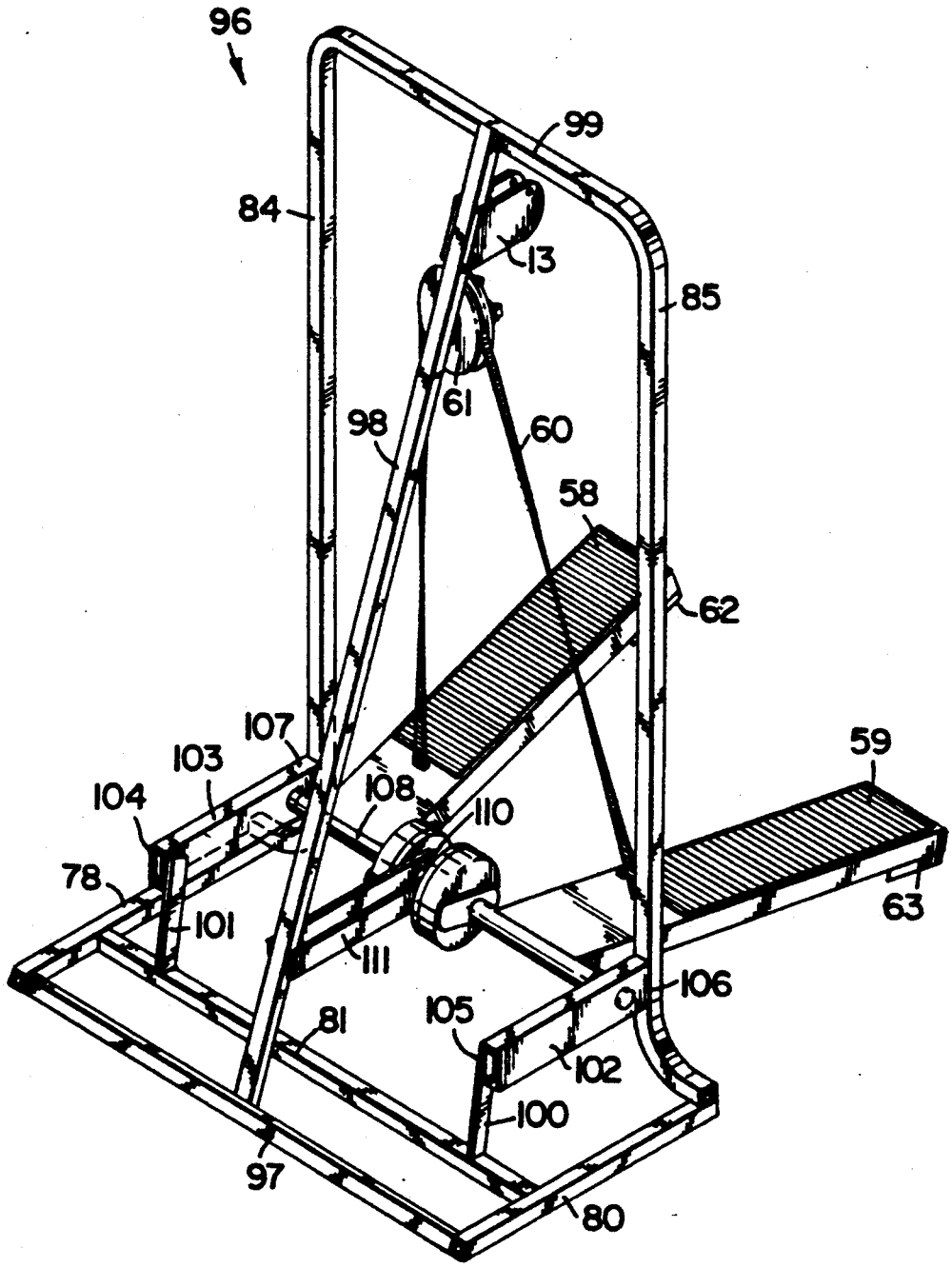
FIG. 11 is a perspective view showing details of a second embodiment of a mechanism used in the device of FIG. 9.

Referring to FIGS. 9–11, a third configuration of the apparatus 1 is described. This third configuration simulates a stair climbing or stair stepping exercise In the stair climbing configuration, foot pads 34 and 35 have been removed from tread 9, although they may be slid to the rearward portion of tread 9, adjacent to spindle 10, if desired.

Right stair step 58 and left stair step 59 are shown after they have been pivoted downwardly from their storage position within pedestal 12. The relative positions of steps 58 and 59 are dictated by their interconnection to each other by means of strap 60, which passes over pulley 61. When fully depressed, one of the steps may come into contact with tread 9, and a small bumper 62, 63 is placed beneath each step surface to prevent marring tread 9.

In the first embodiment of the stair stepper mechanism 64, the steps 65 and 66 are affixed to a pair of tubular support members 67 and 68, respectively. The steps 65 and 66 are constrained to move within parallel planes due to the fact that each has an end 69 and 70 pivotably attached to a single axle 71. The axle is secured in place by slanted bracing members 72 and 73, which have base ends 74 and 75 secured to rail 76.

Rail 76 may be stabilized in a variety of ways, but in one embodiment the first end 77 is secured to orthogonal rail 78 while second end 79 is secured to orthogonal rail 80. A cross member 81 passes between rail 78 and 80 to provide additional stability.

Attached to the ends 82, 83 of the orthogonal members 78 and 80, and opposite rail 76, are vertical supports 84 and 85, which join at horizontal cross member 86.

The upper ends 87 and 88 of sloping support members 72 and 73 are affixed to horizontal cross member 86, thereby providing a secure framework for stair stepping subassembly 64.

In order to provide the appropriate resistance to simulate a stair stepping exercise, the stair step supports 67 and 68 are constrained in their movement by hydraulic or pneumatic cylinders 89 and 90. The lower end 91 of cylinder 90 is clamped or otherwise affixed along support 68 in a region relatively nearer to end 70, such that cylinder 90 assumes a substantially vertical orientation. The upper end 92 of cylinder 90 is attached to axle 93 which passes through sloping support members 72 and 73 and is attached at opposite ends to the upper end 94 of cylinder 89. The lower end 95 of cylinder 89 is attached near pivoting end 69 of the support rod 67, and also assumes a near vertical orientation. The upper ends 90 and 92 of the cylinders 89 and 90 are free to pivot about axle 93, with one cylinder being extended while the other cylinder is compressed during the reciprocating stair stepping motion. The strap 60 is clamped to supports 67 and 68 at a point relatively near the foot steps 66 and 65.

Referring to FIG. 11, a second embodiment 96 of the apparatus 1 may be seen. The brace assembly is somewhat modified such that a relatively smaller rail 97 is rigidly affixed between orthogonal members 78 and 80. A single sloping brace 98 passes between rail 97 and cross bar 99, cross bar 99 being supported between vertical members 84 and 85.

Extending upwardly from cross member 81 are vertical members 100 and 101 which support horizontal axle supports 102 and 103 respectively. The horizontal supports 102 and 103 have a first end 105 affixed to vertical members 100 and 101, respectively, while second ends 106 and 107 are rigidly affixed to a lower end of vertical supports 85, 84 respectively.

Rotatably secured between horizontal supports 102 and 103 is an axle 108, to which are rigidly secured steps or pedals 58 and 59. Axle 108 is supported near its mid-region 110 by cone resistance brace 111, which has an opposite end secured to sloping support member 98.

Affixed to either side of clutch support 111 are conical resistance mechanisms 112 and 113, the operation of which will now be described.

Figure 12:
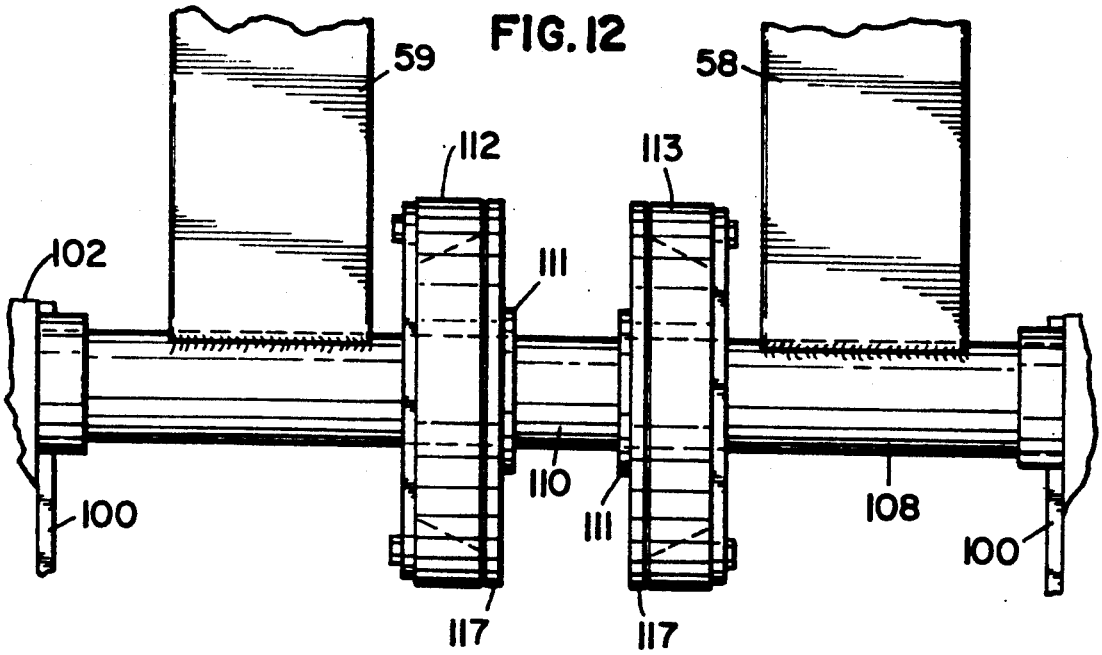
FIG. 12 is an enlarged left-side view of the rotational resistance means comprising a part of the apparatus depicted in FIG. 11.
Figure 14:
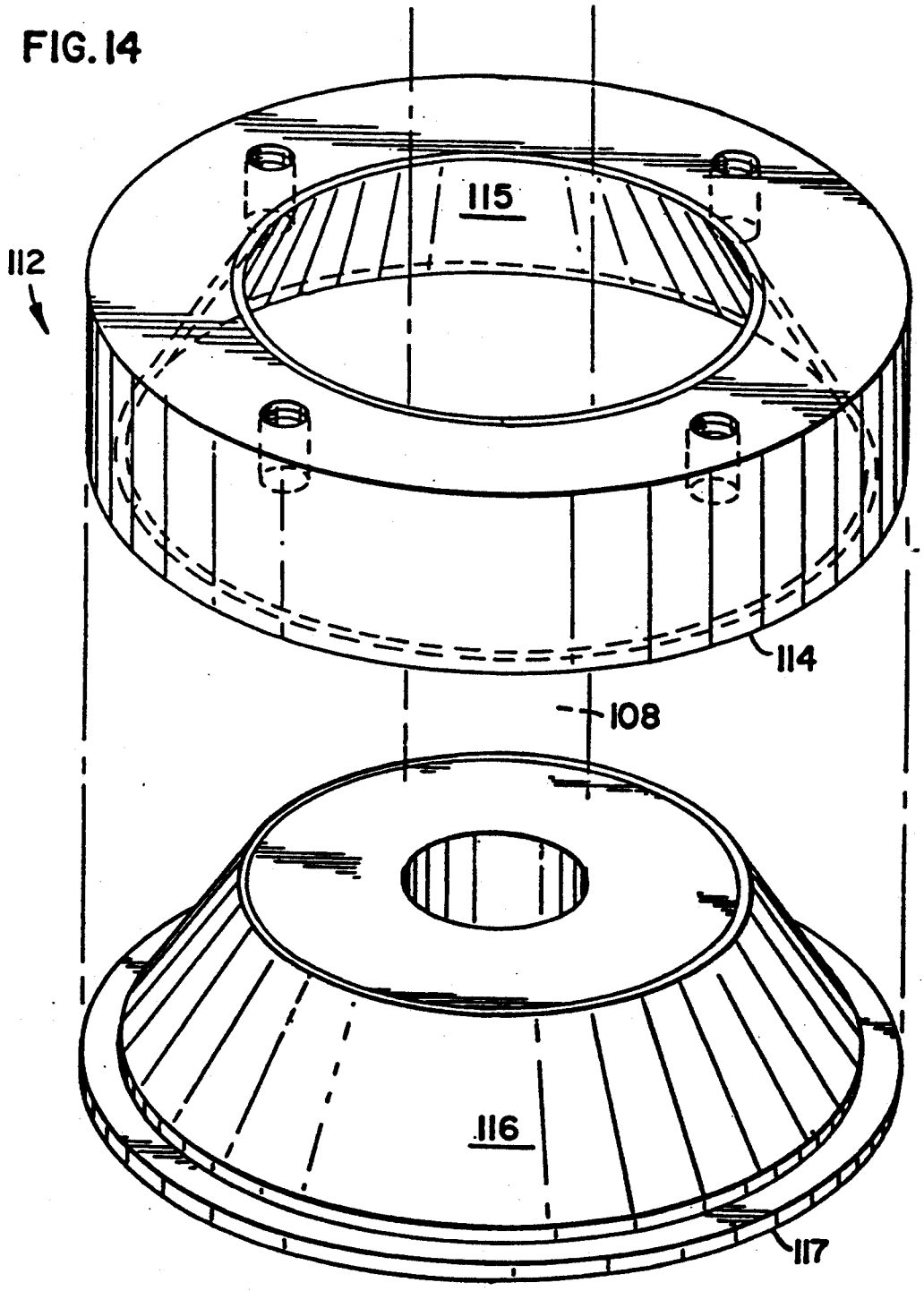
FIG. 14 is an exploded perspective view of the rotational resistance means depicted in FIG. 13.

Referring to FIGS. 12, 14 and 15, in a preferred embodiment the conical resistance mechanism 112 includes a fixed friction member 114 secured relative to the axle 108 by means of clutch support member 111, which is rigidly secured to sloping support member 98. The fixed friction member 114 has a conical internal surface 115 that is coated with a plastic known in the art as "ultra-high molecular weight polyethylene." The conical internal surface 115 faces rearward from the support bracket 111 and is designed to mate with a forwardly facing conical external surface 116 on a coaxially aligned rotatable friction member 117. The conical external surface 116 is coated with rubber, such that rotation of the rotatable friction member 117 relative to the fixed friction member 114 is resisted by a frictional force between the rubber coated conical external surface 116 and the plastic coated surface 115.

A shaft member 108 is coaxially aligned relative to the fixed friction member 114 and the rotatable friction member 117 and passes through centrally located openings therein. The shaft member 108 has a first end that is rigidly secured to the support bracket 111 and an opposite, second end that passes through second clutch 113. A large metal washer (not shown) is rigidly secured to the second clutch 113, and a large nylon washer (not shown) is positioned between the large metal washer and the tube member 108. That portion of the shaft member 108 which passes through the rotatable friction member 117 is substantially smooth about its circumference.

In the embodiment shown in FIG. 15, upon rotation of the shaft member 108 in a first shaft direction S1, the rotatable friction member 117 rotates in conjunction with the shaft member 108 and relative to the fixed friction member 114, thereby providing some degree of resistance to rotational movement.

Upon rotation of the shaft member 108 in a second shaft direction S2, opposite the first shaft direction S1, the shaft member 108 again rotates in conjunction with the rotatable friction member 117, and relative to the fixed friction member 114, again providing some degree of resistance to rotational movement.

By providing resistance to both downward and upward motion, a reciprocating stair stepping motion is provided. As can be seen by reference to FIG. 11, the downward motion of step 59 causes belt 60 to raise step 58, while the lowering of step 58 will necessarily cause belt 60 to raise step 59.

When use of the stair stepping exercise is not desired, each step may be individually folded upwardly into the pedestal 12. At that time, the device may be used either as a treadmill, or, by placing the foot pads 34 and 35 within rails 56 and 57, a cross country skiing exercise may be simulated. Arm 30 may be raised or lowered during any of the three exercises.

Other embodiments of the invention will be obvious to those skilled in the art. Thus, the change of shape of either the treadmill, pedestal, foot pads, or the tubular arm 30 are changes of form, not substance, and do not affect the basic function of the single device which can assist in the performance of three materially different exercises. Such changes are within the scope of the claims which follow.

I claim:

1. An apparatus of the type on which a person exercises, comprising:

(a) a base portion;

(b) a pedestal portion, the pedestal portion having an upper end and a lower end, the lower end being rigidly affixed to the base portion;

(c) a treadmill, the treadmill being mounted within the base portion;

(d) a pair of foot paddles, the foot paddles being pivotally mounted within the pedestal, the foot paddles being capable of a reciprocating up and down motion simulating a stair climbing activity, the foot paddles being capable of pivoting upwardly into the pedestal for storage; and (e) a pair of foot restraints, the foot restraints being slidably mounted on the base portion, the apparatus thereby being capable of selectively performing three discrete exercise functions.

2. The apparatus of claim 1 further comprising:

(a) a pivoting tube member, the pivoting tube member being mounted on the pedestal, the pivoting tube member serving as a mount for an arm exercising device.

3. The apparatus of claim 2, wherein the arm exercising device further comprises:

(a) a drum, the drum being mounted at a first end of the tube member; and (b) a cable, the cable being cooperatively attached to the drum such that each end of the cable may be grasped by a person while performing another exercise activity with the apparatus.

4. The apparatus of claim 3, wherein the treadmill is of an endless conveyor type, the conveyor having a forward spool and a rearward spool, the treadmill being formed as a continuous belt passing around both the forward and rearward spools.

5. The apparatus of claim 4, further comprising a torso support, the torso support being pivotably mounted near the upper end of the pedestal, the torso support being capable of engaging a torso region of a person exercising on the apparatus.

6. The apparatus of claim 5, wherein the torso support comprises:

(a) a plurality of handles, the handles being graspable by a person exercising on the apparatus; and (b) a pad, the pad being capable of directly bearing against the portion of a person exercising on the apparatus.

7. The apparatus of claim 6, wherein the apparatus further comprises:

(a) a first rail, the first rail being formed within the base portion, the rail being substantially parallel to the direction and motion of the treadmill; and (b) a second rail, the second rail being formed within the base portion of the apparatus, the second rail being substantially parallel to the direction and motion of the treadmill.

8. The apparatus of claim 7, wherein each foot restraint is formed so as to have a rail engaging member, the rail engaging member being slidably mounted on either the first or second rail formed within the base portion, thereby permitting a sliding motion by an exerciser's foot along a rail adjacent to the treadmill.

9. The apparatus of claim 8, wherein each pivotable foot paddle is cooperatively connected to a hydraulic cylinder, the hydraulic cylinder being pivotably attached at a first end to the foot paddle and being pivotably attached at a second end to an upper region of the pedestal, the cylinder providing resistance to a downward motion of the foot paddle while providing substantially no resistance to an upward movement of the foot paddle.

10. The apparatus of claim 9, wherein the foot paddles are interconnected by a belt, the belt passing through a pulley cooperatively connected to an upper region of the pedestal, the belt causing a downward motion on the part of one foot paddle to raise the other foot paddle, thereby creating a reciprocating motion simulating a stair climbing activity.

11. The apparatus of claim 8, further comprising:

(a) an axle, the axle being mounted in a substantially horizontal orientation near the base region of the pedestal, a foot paddle being attached near each end of the axle; and (b) a rotational resistance means operatively connected to the axle between the first and second foot paddle, for providing resistance to rotation in a given direction up to a given load.

12. An apparatus according to claim 11, wherein said rotational resistance means includes:

(a) a friction member rigidly secured to the pedestal having a conical internal surface;

(b) a rotatable friction member having a conical external surface in contact with said conical internal surface of said fixed friction member, wherein rotation of said rotatable friction member relative to said fixed friction member is resisted by a frictional force between said conical external surface and said conical internal surface, the axle being coaxially aligned relative to said fixed friction member and said rotatable friction member, and passing through centrally located openings therein, wherein said axle has a first end and a second end, and a portion of said shaft member passes through said rotatable friction member, and upon rotation of the axle in a first shaft direction, said rotatable friction member rotates in conjunction with said shaft member and relative to said fixed friction member, and upon rotation of said axle in a second shaft direction, opposite said first axle direction, said shaft member rotates in conjunction with said rotatable friction member and relative to said fixed friction member.

13. An exercise apparatus capable of simulating running, walking, stair climbing and cross country skiing activities, comprising:

(a) a vertical support frame, the vertical support frame having an upper end and a lower end;

(b) an inclined base frame, the inclined base frame having a rearward end and a forward end, the forward end of the inclined base frame being rigidly affixed to the bottom portion of the vertical frame;

(c) a first axle, the first axle being mounted near the forward end;

(d) a second axle, the second axle being mounted near the rearward end of the base frame;

(e) an endless belt, the endless belt passing over and around the first axle and the second axle, thereby forming a treadmill, the treadmill being suitable for simulating a walking and running exercise activity;

(f) a pair of removable foot restraints, the removable foot restraints being slidably mounted on the base frame, thereby permitting simulation of a cross country skiing activity; and (g) a pair of reciprocating pivotable foot paddles, the reciprocating food paddles being pivotably mounted near the intersection of the base frame and the vertical frame, the foot paddles reciprocating so as to simulate a stair climbing activity.

14. The apparatus of claim 13, further comprising a rotational resistance means, the rotational resistance means being cooperatively connected to the pivotable foot paddles, thereby causing resistance to a downward motion of a foot paddle and causing resistance to an upward motion of a foot paddle.

15. The apparatus of claim 14 further comprising (1) a pulley, the pulley being cooperatively connected to an upper region of the vertical frame member; (2) a belt, the belt passing through the pulley, the belt having a first end and a second end, the first end of the belt being connected to one pivotable foot paddle, the second end of the belt being cooperatively attached to the second foot paddle, such that the downward motion of one foot paddle will tend to induce an upward motion in the other foot paddle.

16. The apparatus of claim 15, further comprising first and second pneumatic cylinders, each pneumatic cylinder having a first end and a second end, the first end of each pneumatic cylinder being pivotably connected to an upper region of the vertical frame, and the second end of one of the pneumatic cylinders being pivotably connected to one of the foot paddles, the pneumatic cylinders providing resistance to downward motion of a foot paddle while providing substantially no resistance to upward movement of a foot paddle.

17. The apparatus of claim 15, further comprising first and second conical resistance mechanisms, one of each conical resistance mechanisms being cooperatively connected to one of the foot paddles, the conical resistance mechanism providing resistance to downward rotation of the foot paddle and providing resistance to upward rotation of the foot paddle.

18. The apparatus of claim 17, further comprising a torso pad, the torso pad being pivotably interconnected to an upper portion of the vertical frame, the torso pad engaging the body of a person forming an exercise activity on the apparatus.

19. The apparatus of claim 18, wherein the base member has a left side and a right side, the left side and right side each being formed so as to have a rail, the rail including a longitudinal groove, the longitudinal groove engaging a portion of the foot restraints such that the foot restraints are slidable along the rail during the cross country skiing activity.

20. The apparatus of claim 19, wherein each foot restraint is formed so as to have a substantially planar upper surface and a substantially planar bottom surface, a pair of rollers being rotatably mounted on the bottom surface of the foot restraint, each roller incorporating a one-way clutch so as to permit the foot restraint to roll along the treadmill only in a forward direction during the cross country skiing activity.

21. An exercise device including components to perform three discrete exercise activities, comprising:

(a) a treadmill, the treadmill being formed as a substantially planar endless conveyor, the treadmill being inclined so as to form an angle between 3° and 15° to a horizontal surface;

(b) a first and second foot paddle, the first foot paddle having a first end and a second end, the first end being pivotably mounted near a forward region of the treadmill, the second end having a foot engaging surface, the second foot paddle having a first end pivotably mounted near a forward region of the treadmill, and having a second end formed so as to have a foot engaging surface, the pivotable foot paddles being interconnected by a belt, the belt being restrained by a pulley so as to cause a reciprocating motion of the foot paddles;

(c) a pair of conical resistance mechanisms, one of each conical resistance mechanism being cooperatively connected to one of the reciprocating foot paddles, the conical resistance mechanism resisting rotation of the first end of the foot paddle in a downward direction and thereby providing resistance to downward movement of the second end of a foot paddle, thereby providing simulation of a stair climbing exercise; and (d) a pair of foot restraints, the foot restraints being slidably mounted adjacent to the treadmill, the foot restraints being constrained to move along an axis parallel to the direction and movement of the treadmill, the foot restraints being capable of a reciprocating motion along the plane defined by the treadmill, the foot restraints rolling in a forward direction, the foot restraints frictionally sliding in a rearward direction, thereby simulating a cross country skiing exercise.

* * * * *